United States Patent [19]

Canalizo

[11] Patent Number: 4,516,917

[45] Date of Patent: May 14, 1985

[54] WELL PUMPING APPARATUS AND METHOD

[75] Inventor: Carlos R. Canalizo, Dallas, Tex.

[73] Assignee: Otis Engineering Corporation, Dallas, Tex.

[21] Appl. No.: 479,458

[22] Filed: Mar. 28, 1983

[51] Int. Cl.[3] ..... F04B 47/08; E21B 17/046

[52] U.S. Cl. ..... 417/390; 417/393; 166/318; 166/324; 166/333; 166/334

[58] Field of Search ..... 166/317, 322, 237, 333, 166/334, 318, 239, 324; 417/390, 393, 397, 403, 404, 358, 448, 450

[56] References Cited

U.S. PATENT DOCUMENTS

| | | | |
|---|---|---|---|
| 2,315,921 | 4/1943 | Baker | 166/237 X |
| 3,051,244 | 8/1962 | Litchfield | 166/317 |
| 4,293,287 | 10/1981 | Carrens | 417/393 |

FOREIGN PATENT DOCUMENTS

| | | | |
|---|---|---|---|
| 2077366 | 12/1981 | United Kingdom | 417/404 |

*Primary Examiner*—Leonard E. Smith
*Attorney, Agent, or Firm*—Albert W. Carroll

[57] ABSTRACT

A downhole well pump powered by pressurized fluid conducted to it through a power fluid conduit connected to its upper end by a remotely releasable connector which makes it possible to run and retrieve the pump either at the time the power fluid conduit is run or retrieved, or separately, and when run or pulled separately either through use of the conduit or other means such as wireline, rods, pipe, or the like, the connector being releasable simply by dropping a ball into the conduit and then building fluid pressure against the ball. Actuation of the connector to disconnect also opens a drain or equalizing passage in the pump automatically. The power fluid conduit being inside the well tubing makes it practical to install this pump in wells having casing of sizes insufficient to accommodate power fluid conduits exterior of the tubing. Installations and methods for their preparation are also disclosed. Gas lift valves may be used in the power fluid conduit, where the power fluid is gas.

14 Claims, 12 Drawing Figures

WELL PUMPING APPARATUS AND METHOD

BACKGROUND OF THE INVENTION

1. Field of the Invention

This invention relates to downhole well pumps and more particularly to well pumps powered by fluid pressure and to methods for using such pumps.

2. Description of the Prior Art

Downhole fluid powered pumps have been used for many years to lift production fluids from wells having insufficient bottom hole pressure to flow on their own. In most installations utilizing such fluid powered pumps, pressurized power fluid is conducted to the pump from the surface via a power fluid conduit extending exteriorly of and alongside the well tubing in which the pump is installed. Of course, if the well is equipped with a packer to seal the tubing-casing annulus below the pump, such annulus may be utilized to conduct power fluid to the pump, if desired. Such pump and installations are illustrated and described in my co-pending Application for Letters Patent for DOWNHOLE DOUBLE ACTING PUMP filed Jan. 7, 1983, Ser. No. 06/456,366, which application is a continuation application of my previously filed application, Ser. No. 06/152,529, filed May 22, 1980, now U.S. Pat. No. 4,405,291, which issued Sept. 20, 1983. Disclosed in these two prior applications is a double acting pump having two pump chambers which are axially aligned. A piston is reciprocable in each chamber, and they are connected together by a piston rod. The piston rod passes through a pilot valve mechanism positioned between the two chambers. Power fluid which may be gaseous or liquid, preferably compressed gas, enters the pump through a lateral port in its midsection, and the pilot valve directs such power fluid into each of the chambers alternately. As one of the pistons approaches the pilot valve mechanism, it engages the pilot valve and shifts it to the other of its two positions to direct the power fluid into the other chamber and to exhaust the first one. This spent power fluid is allowed to commingle with the pumped production fluids, and this aids in lifting them to the surface through the well tubing.

The present invention is an improvement over the apparatus of my co-pending application just discussed. This improved pump is particularly suitable for use in wells having small diameter casing since the power fluid conduit is located inside the tubing in which the pump is located, thus eliminating the danger of damaging the conduit.

Typical prior art downhole pump devices include the pump disclosed in U.S. Pat. No. 3,617,152 to Leslie L. Cummings. The pump of Cummings utilizes a compressed gaseous medium, such as gas or air, to displace well production fluids from the well and lift them to the surface. This pump is a single acting pump and requires relatively high pressure power gas in order to lift the well production fluids to the surface.

U.S. Pat. No. 4,084,923 to George K. Roeder discloses a downhole pump utilizing hydraulic fluid pressure for its operation. The pistons of the Roeder pump are driven by more than one engine, and a tubular piston rod supplies power fluid to a lower engine. Power oil may be conducted to the pump through a small conduit inside the well tubing, this being aided by the hollow piston rod.

It is desirable to provide a double acting downhole pump which can be run and pulled on a small diameter power fluid conduit, making such pump suitable for use in wells having casing so small that a suitable power fluid conduit cannot be placed in the tubing-casing annulus. It is further desirable to provide a remotely releasable connector for attaching such conduit to the pump, thus making it possible to release the conduit and remove it from the well without removing the pump.

The present invention overcomes the limitation of the double acting pump of my co-pending application as regards casing size since it can be run in tubing in wells having very small casing because the pump receives power fluid through a concentric conduit located in the tubing and attached to the upper end of the pump. This attachment is made by a remotely releasable connector enabling the pump and conduit to be run and/or pulled together or separately.

SUMMARY OF THE INVENTION

The present invention is directed to a downhole well pump which is connectable to a power fluid conduit such as a small diameter pipe string or coil tubing and lowered thereby into place in a receptacle which forms a part of the tubing and which may be withdrawn from the well tubing by withdrawing the power fluid conduit. An important aspect of the invention is provision of a remotely releasable connector between the conduit and the pump which makes it possible to disconnect the conduit from the pump and remove the conduit from the well without the pump, as may be desirable should the pump become fouled in the receptacle.

OBJECTS OF THE INVENTION

It is one object of this invention to provide a well pump which may be run into or withdrawn from a well tubing on a power fluid conduit capable of conducting power fluid thereto, the pump and conduit being connected together by a remotely releasable connector.

Another object is to provide such a connector which is releasable remotely by dropping a ball or the like into the power fluid conduit, allowing it to engage the connector, and pressurizing the conduit to actuate the connector to releasing position, permitting the conduit to be pulled from the well independent of the pump.

Another object of this invention is to provide such a well pump which is particularly suitable for use in wells having a very narrow annulus between the tubing and casing.

Another object is to provide such a well pump having an openable equalizing passage to facilitate removal of the pump from the well.

A further object is to provide such a well pump in which the equalizing passage is opened automatically when the connector is actuated to releasing position.

A further object is to provide such a well pump including a receptacle therefor connectable to a string of well tubing and having ports and bypass passages suitable for conducting power fluid and well fluids to and away from the pump separately.

Another object is to provide a well installation utilizing a well pump of the character described.

A further object is to provide a well installation utilizing a well pump of the character described and wherein one or more gas lift valves are included in the power fluid conduit.

Another object is to provide methods for installing, operating, and removing well pumps of the character described, the pump being run and pulled on a power fluid conduit or run and pulled separate from the conduit.

A further object of this invention is to provide methods of the character described wherein the power fluid conduit is provided with at least one gas lift valve.

Other objects and advantages will become apparent from reading the description which follows and studying the drawing, wherein:

DESCRIPTION OF THE PREFERRED EMBODIMENT

Figure 1:
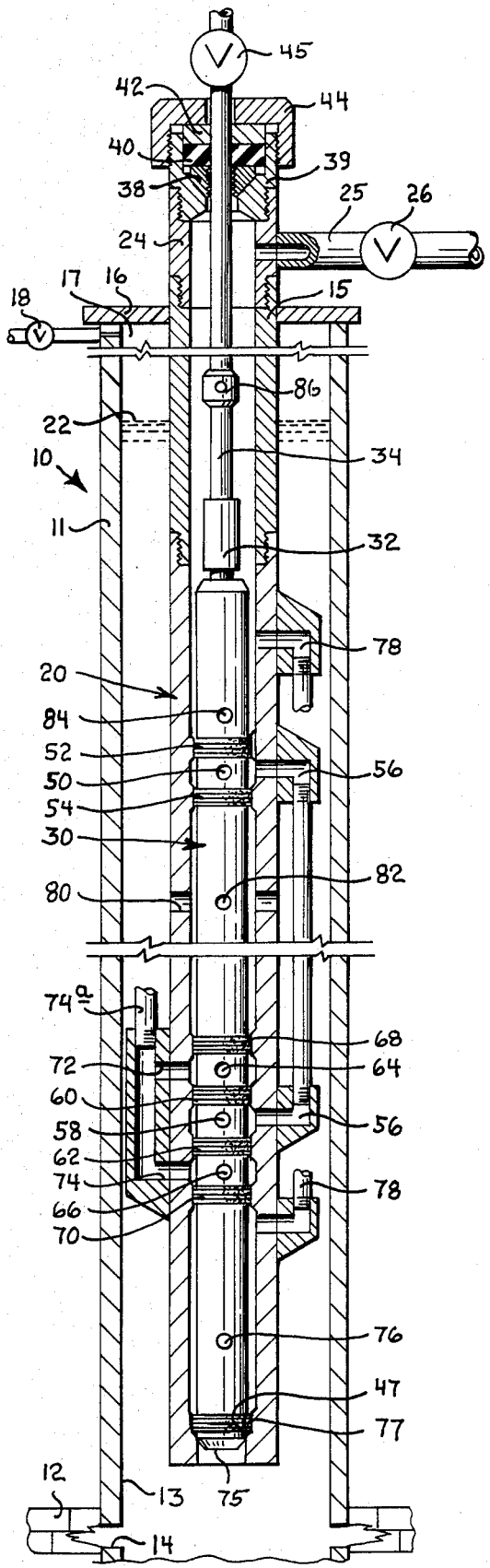
FIG. 1 is a diagrammatical view showing a well equipped with a downhole well pump in accordance with this invention.

Referring now to FIG. 1, it will be seen that a well 10 has its casing 11 extending from the surface to a producing formation 12 and that the bore 13 of the casing has communication with the formation 12 through the casing perforations 14. A well tubing 15 is disposed in the casing 11, and a casing head 16 seals the upper end of the casing about the tubing, thus closing the upper end of the tubing-casing annulus 17. A valve 18 at the upper end of the casing allows fluids to be injected into the annulus or to be bled therefrom.

The tubing 15 includes a receiver or receptacle 20 located at some depth in the well and necessarily a preferred distance below the liquid level 22 therein. The upper end of the tubing is connected to a surface fitting or connection which may be a simple Christmas tree or even a simple fitting such as fitting 24 having a flowline 25 fluidly connected thereto and including a wing valve 26 for controlling flow therethrough.

A fluid powered downhole well pump 30 is disposed as shown in the receptacle 20 and is connected by connector means 32 to a power fluid conduit 34 which extends to the surface and beyond the surface fitting 24. This power fluid conduit 34 is suspended from a set of gripping slips 38 disposed in a tapered bowl 39 attached to the upper end of fitting 24. A resilient seal ring 40 surrounds the conduit 34 and is compressed against the upper side of slips 38 by junk ring 42 forced down by gland nut 44 screwed onto the bowl 39 as shown. Thus, fluids may not escape from around the conduit. A valve 45 controls the flow of fluids through the conduit.

Production fluids from the formation 12 enter the casing bore 13 through perforations 14 and are to be pumped to the surface through the tubing 15 and discharged through flowline 25 by the pump 30 which receives pressurized power fluid conducted to it from the surface through power fluid conduit 34. The source of this power fluid is not shown but would normally be a compressor or a gas well for supplying gas at a suitable pressure (probably 700 to 1500 pounds per square inch).

Pump 30 and receptacle 20 may be very similar to the double acting fluid powered downhole well pump and receptacle disclosed in my aforementioned co-pending patent application, Ser. No. 06/456,366, but modified to permit placing the power fluid conduit within rather than without the well tubing, as will be explained. Thus, the pump 30 may be run and pulled on the power fluid conduit 34. The connector 32 is remotely releasable. Thus, should the pump prove too difficult to pull from the receptacle by pulling on the power fluid conduit, the connector 32 can be released and the conduit removed without it. If desired, a retrieving tool could then be run into the well tubing as on a suitable wireline (not shown) or pipe string (not shown) to engage and withdraw the pump.

In any case, pump 30 is supported in the receptacle 20 upon annular no-go shoulder 47. My previously filed application for U.S. patent filed May 22, 1980, entitled DOWNHOLE DOUBLE ACTING PUMP, and given Ser. No. 06/152,529 and the continuation application thereof, Ser. No. 06/456,366, filed Jan. 7, 1983, now U.S. Pat. No. 4,405,291 which issued Sept. 20, 1983 are incorporated herein for all purposes.

During operation of pump 30, pressurized power fluid is injected into the power fluid conduit 34 at the surface. This power fluid moves downwards through conduit 34, passes through connector 32, and enters the upper end of the pump 30. This power fluid exits the pump through port 50, located between seals 52 and 54, and flows through bypass 56 to the power fluid intake port 58, located between seals 60 and 62.

Spent power fluid exits the pump through upper and lower exhaust ports 64 and 66 spaced above and below intake port 58 as shown. Exhaust port 64 is located between seals 60 and 68 while exhaust port 66 is located between seals 62 and 70.

Seal rings 52, 54, 60, 62, 66, and 68 are carried by pump 30 and sealingly engage the inner wall of receptacle 20 as shown to prevent unwanted fluid communication and leakage in the usual and well-known manner.

Spent power fluid exiting exhaust ports 64 and 66 flow through receptacle ports 72 and 74 into the annulus 17 exterior of the receptacle. Preferably, an exhaust tube **74*a* is connected to exhaust ports 72 and 74 of the receptacle and carries the spent exhaust fluids upwardly in the annulus 17** to a location above the pump and even to a location above the liquid level in the annulus, if desired. If the power fluid is gas, as would more often be the case, the exhaust gases should certainly be piped to a location in the annulus well above the pump lest they re-enter the pump through the upper intake ports described hereinbelow.

Pump 30 has upper and lower pump sections, one above the upper pump exhaust port 64 and one below the lower exhaust port 66.

Well fluids from the casing bore 13 enter the lower open end 75 of pump 30 and are discharged through discharge port 76 to move upwardly between the pump and the receptacle to enter production fluid bypass 78 and be transported to the upper portion where they are emptied back into the tubing just above the topmost seals 52.

At the lower end of pump 30, seal rings 77 seal between the pump and the receptacle below discharge port 76 to prevent production fluids from leaking therepast.

Well fluids from the casing also enter the upper pump section through receptacle ports 80 and production fluid intake port 82. They are discharged into the tubing through discharge port 84 above topmost seals 52.

Thus, well fluids discharged by both the upper and the lower pump sections are dumped into the well tubing at the upper end of the pump and, from there, are forced upwardly through the tubing to the surface as pumping continues.

The pilot valve section which contains the power fluid intake and exhaust ports 58, 64 and 66 as well as the upper and lower pump sections may be identical to those of my aforementioned co-pending applications.

It should be understood that power fluid conduit 34 may comprise a single piece of coil tubing, or it may be composed of jointed pipe, or be composed principally of coil tubing with one or more joints of pipe at its lower end or upper end, or both. If it is principally of coil tubing, certainly a few joints of pipe at its lower end might be desirable to provide stiffness and weight which may help in aligning the pump with the receptacle and in seating it therein, as well as in holding it in place.

Also, it may be desirable to place at least one joint of pipe at the surface to provide a sturdy place for the slips 38 to grip and a sturdy connection for the valve 45.

In some cases where the power fluid is a gas, it may be desirable to place one or more suitable gas lift valves, such as gas lift valve 86, in the power fluid conduit 34 to permit controlled admission of some of the power gas into the surrounding annulus to aid in lifting the production fluids to the surface. Such valves would be of the casing-flow type.

Figure 8:
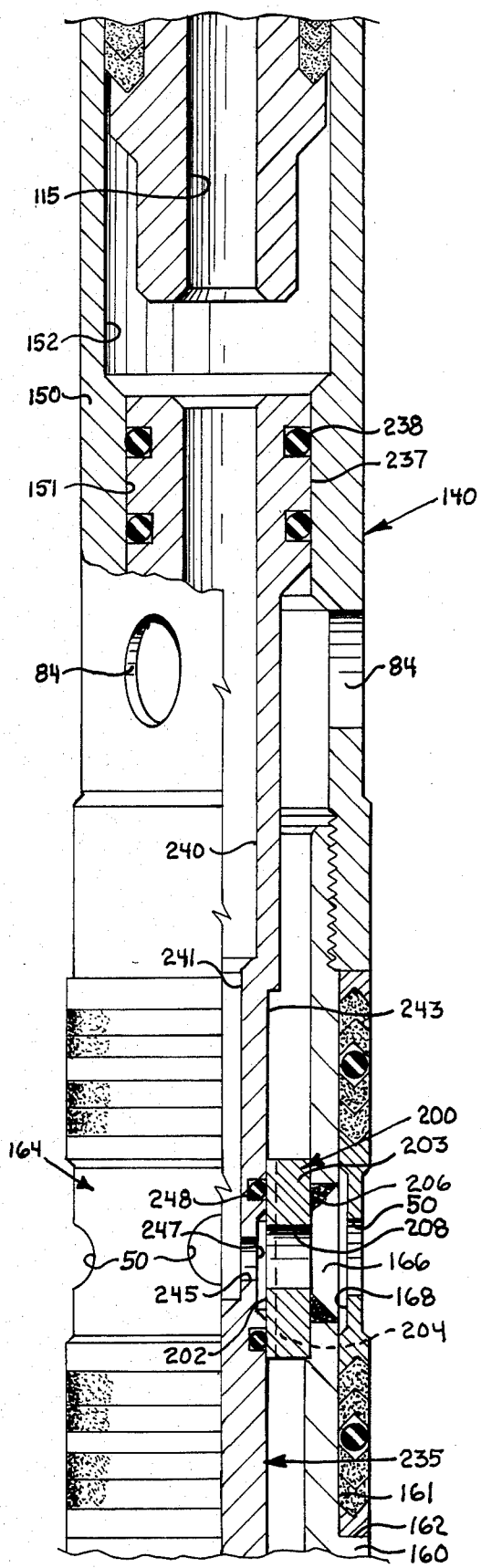
FIG. 8 is a magnified fragmentary longitudinal view, partly in section and partly in elevation, showing that portion of the well pump which is shown in the upper portion of FIG. 2B.

Referring now to FIGS. 2A–2D, and to FIG. 8, it will be seen that the power fluid conduit 34 is connected to the upper end of the pump 30 by remotely releasable connector 32.

Figure 2A:
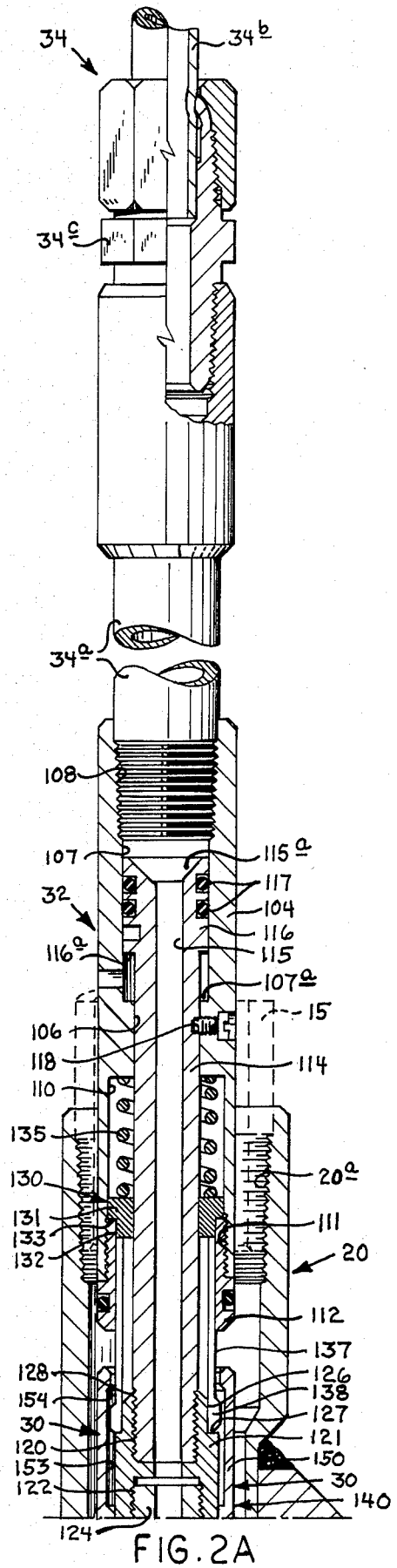
FIGS. 2A, 2B, 2C, and 2D, taken together, constitute a longitudinal view, partly in elevation and partly in section, with some parts broken away, showing the well pump and its receiver or landing nipple which are constructed in accordance with this invention.

In FIG. 2A, a quantity of jointed pipe 34*a* is threaded to the upper end of releasable connector 32, and this jointed pipe has its upper end connected to the lower end of a length of coil tubing 34*b* through use of a hydraulic type connector 34*c* which could as well have its lower end threaded directly into the upper end of the releasable connector should the jointed pipe be deemed unnecessary. The coil tubing 34*b* may extend to the surface, or it may connect to one or more joints of jointed pipe, one joint of which may be supported in the slips 38 (see FIG. 1) which are not shown in FIG. 2A, but which would be provided at the surface.

Releasable connector 32 has a tubular body 104 having a central bore 106 which is enlarged at its upper end as at 107 and threaded at 106 to receive jointed pipe 34*a*. Enlarged bore 107 provides upwardly facing shoulder 107*a*.

Bore 106 of connector housing 104 is enlarged at its lower end as at 110 and is threaded as at 111 to receive the lower end piece 112 as shown. A tubular body or core 114 is disposed within housing 104 as shown. This body has a central bore 115 which is flared at its upper end to provide a seat surface 115*a*. The upper end portion is enlarged as at 116, and this enlargement is formed with suitable external seal ring grooves in which are located seal rings 117 which seal between the body and housing. Enlargement 116 provides a downwardly facing shoulder 116*a* which is engageable with shoulder 107*a* in the housing to limit its longitudinal downward movement therein. Suitable shear means such as shear pin or shear screw 118 releasably maintains the body in its normal position shown and must be sheared to permit downward movement of the body to its lowerpost position, shown in FIG. 6A.

The lower end of body 114 is threadedly attached as at 120 to the upper end of body extension 121 which, in turn, is threadedly connected as at 122 to seal mandrel 124. The seal mandrel carries suitable seal means such as seal ring set 125. Body extension 121 has its outside diameter reduced at its upper end as at 126 providing upwardly facing shoulder 127, as shown, and its upper end surface is upwardly convergent providing cam surface 128.

A collet 130 having a body 131 whose diameter is reduced as at 132 providing downwardly facing shoulder 133 surrounds the connector body 114 and is slidably disposed in the lower portion of connector housing 104.

The collet 130 is provided with a plurality of dependent fingers 137, each having an external boss 138 at its lower end as shown. A spring 135 biases the collet downwardly to its lowermost position wherein the lower ends of the collet fingers 137 surround reduced portion 126 of the body extension 121, and their extreme lower ends are in engagement with the extension's upwardly facing shoulder 127. The mandrel extension 121 thus holds the collet fingers against inward movement so that their outer bosses 138 extend outwardly beyond the periphery of the extension 121.

The connector 32 automatically latches to the pump 30 when it is inserted fully into the open upper end of the pump, in a manner soon to be described.

Pump 30 is an improvement over and is almost identical to the downhole double acting pump illustrated and described in my aforementioned co-pending application, Ser. No. 06/456,366, and operates in the same manner. The principal differences between these two pumps result from provision of connecting the present pump to a suitable power fluid conduit so that power fluid may be supplied via this conduit which is disposed inside rather than outside the tubing, and in the means of actuating the equalizing mechanism. In addition, the instant pump necessarily has means for routing power fluid from its upper end to its midsection through a bypass passage, a portion of which is necessarily built into the landing receptacle making it also slightly different from that disclosed in my just mentioned co-pending patent application.

Pump 30 comprises a number of sections which (listed from top to bottom) are: head section 140, upper chamber section 141, valve section 142, and lower chamber section 143.

Pump 30 is shown to be installed in receptacle 20 which, for economic reasons, is made up of several tubular sections joined together as by threading. It is obvious that the receptacle could be made a singular tubular section or in fewer sections than shown in the drawing.

Receptacle 20 is provided with upwardly facing stop shoulder 47 (FIG. 2D) and polished bore portion 48 near its lower end and below stop shoulder 47. Its lower end may be connected to tubing 15 as shown, or the receptacle may constitute the lowermost section of tubing, as desired, with no tubing extending below it. Other polished bore portions are spaced above stop shoulder 47 as at 48*a*, 48*b*, 48*c*, 48*d*, and 48*e* as shown. These polished bore portions receive the various seal ring sets which seal between the pump and the receptacle at locations above and below the various ports in the wall thereof, namely (from top down): power fluid exit or bypass port 50, upper production fluid inlet port 82, upper exhaust port 64, power fluid intake port 58, lower exhaust port 66, and lower production fluid discharge port 76. The upper production fluid discharge port 84 is located above uppermost seal ring set 52 on the pump. The lower production fluid inlet port is at the lower end of the pump, being the open lower end 75 of the pump.

It may be desirable to provide a downwardly facing shoulder 87 in the receptacle 20 as at the lower end of polished bore 48, and to provide the pump 30 with a snap ring such as the ring 88, so that as the pump is installed in the receptacle, the ring 88 will compress and pass through polished bore 48 and then expand below receptacle shoulder 87 to help retain the pump in the receptacle.

The operation of the pumping mechanism of the pump is exactly as that described in my aforementioned co-pending application, which has been incorporated herein for all purposes.

Power fluid at suitable pressure is conducted to the downhole pump through the power fluid conduit and is directed to the power fluid intake port 58 in a manner to be described. The pressurized power fluid powers the upper and lower pumping mechanisms (not shown) which are located in the upper and lower pump chambers 141 and 143, respectively. Spent power fluid from these upper and lower pumping mechanisms flows from the pump through upper and lower exhaust ports 64 and 66 respectively.

The lower pump chamber 143 takes in well production fluids through the open lower 75 end of the pump and discharges them from the pump through lower production fluid discharge port 76. The upper pump chamber takes in well production fluids through upper production fluid intake ports 82 and discharges them from the pump through upper production discharge port 84.

It will be seen that, since the upper production fluid discharge port 84 is located above the power fluid bypass port 50, a crossover type structure must be provided in the pump. This structure will soon be described.

Head section 140 of pump 30 comprises tubular upper housing member 150 having a bore 151 enlarged thereabove as at 152 providing a polished bore and further enlarged as at 153 providing an internal annular recess with a downwardly facing shoulder 154 at its upper end. This recess and shoulder constitute an internal fishing neck which is engageable by well-known running and retrieving tools, such as those available from Otis Engineering Corporation, Dallas, Tex., and also shown to be engaged by connector 32 described hereinabove and illustrated in FIGS. 2A and 6A.

Bore 151 of upper housing section 150 is enlarged toward its lower end as at 156 and is internally threaded as at 157 for attachment to tubular crossover housing 160. This crossover housing has its upper end portion reduced in outside diameter as at 161 providing an upwardly facing external annular shoulder 162 which supports seal ring sets 52 and 54 with lantern ring 164 therebetween. Seal ring sets 52 and 54, together with lantern ring 164, are retained in place upon the crossover housing 160 by the lower end face of upper housing section 140 which constitutes a downwardly facing shoulder 140*a* opposing shoulder 162.

In the wall of enlarged bore 156 of the upper housing section 140, production discharge means is provided, preferably in the form of a plurality of lateral discharge ports such as ports 84.

Figure 3:
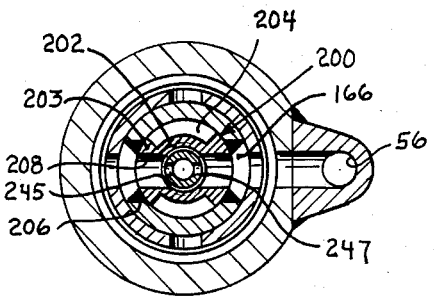
FIG. 3 is a cross-sectional view taken along line 3—3 of FIG. 2B.
Figure 4:
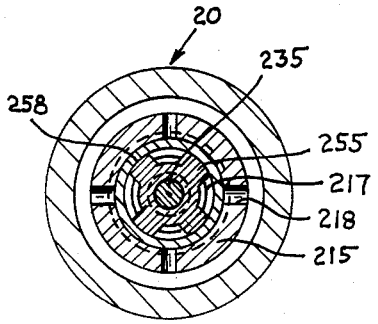
FIG. 4 is a cross-sectional view taken along line 4—4 of FIG. 2B.
Figure 5:
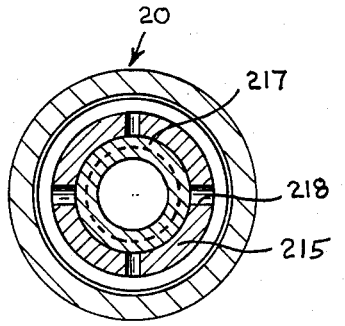
FIG. 5 is a cross-sectional view taken along line 5—5 of FIG. 2B.

The crossover housing 160 has a pair of opposed lateral bypass ports 166 formed in the wall thereof at a location on a level with the midsection of lantern ring 164. FIG. 3 represents a cross section through the housing 160 at ports 166. Lantern ring 164 is formed with a plurality of bypass ports 50 through its wall at its midsection, and these ports open into an internal recess 168 which allows free fluid communication between the bypass ports 50 of the lantern ring and the bypass ports 166 of the crossover body.

A spider 200, better seen in the magnified view of FIG. 8, having a central bore 202 is disposed in the upper housing section 140 and has a pair of opposed legs 203 which are aligned with the crossover ports 166 of the housing, and the spider is sealingly welded to the housing 140 as at 206, providing a pair of vertical flow passages 204 therebetween. Each leg 203 of the spider 200 is provided with a lateral passage 208 providing communication of central bore 202 with bypass ports 50 of the lantern ring as shown in FIGS. 2A and 3.

The lower end portion of bypass housing 160 is reduced in outside diameter and threaded as at 212 for attachment to the upper end of equalizing sub 215, which may be exactly like the equalizing sub of the pump disclosed in my aforementioned earlier filed co-pending applications. In fact, the equalizing sub 215 and the equalizing valve 217 disposed therein, together with the remainder of the pump therebelow, may be exactly like the pump in my aforementioned prior co-pending applications.

The equalizing sub 215 has at least one lateral equalizing port 218 in its wall, and the equalizing valve 217 is normally in position covering the port and has its pair of seal rings 220 sealing above and below the port to prevent leakage therethrough. The equalizing valve 217 is provided with a plurality of resilient dependent legs 224 which normally rest upon upwardly facing inclinded shoulder 222 in the sub 215. The equalizing valve is movable to a lower position shown in FIG. 6B by applying a downward force thereto sufficient to overcome the detent effect and cause the legs 224 to be cammed inwardly by cam shoulder 222 and causing them to enter the tighter bore just below shoulder 222.

The equalizing valve is moved to port opening position (shown in FIG. 6B) by means which will soon be described.

Figure 2B:
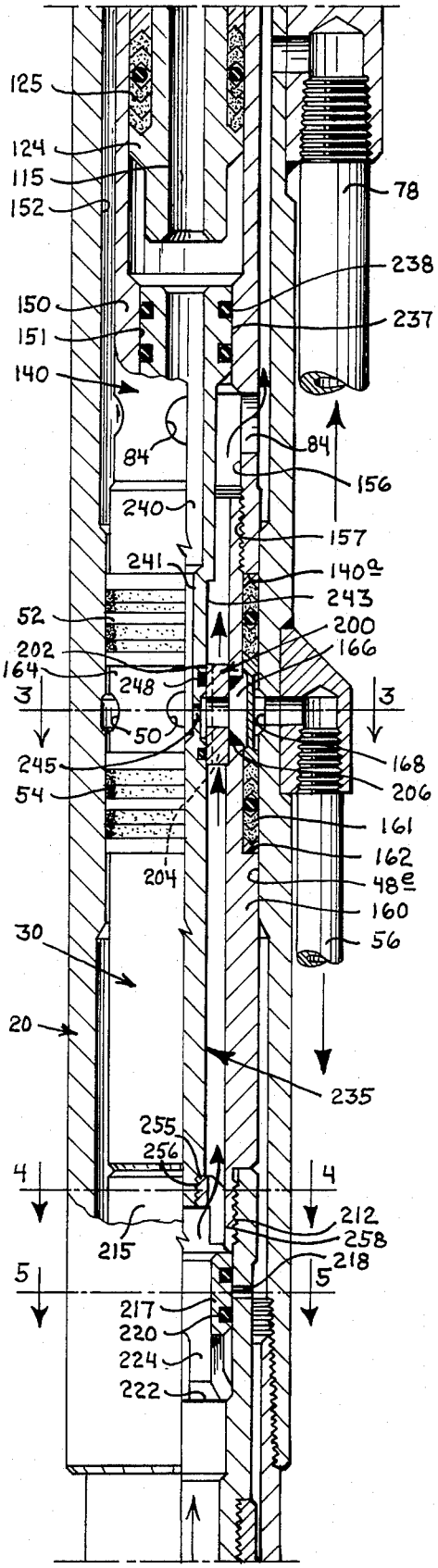
Figure 2C:
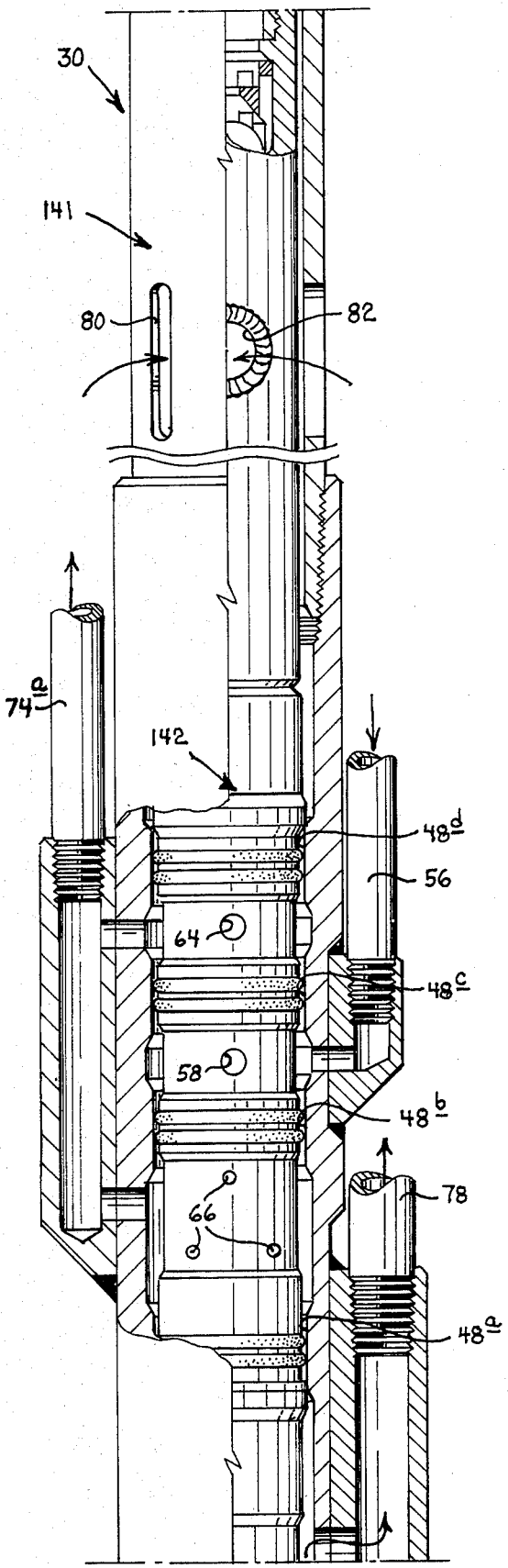
Figure 2D:
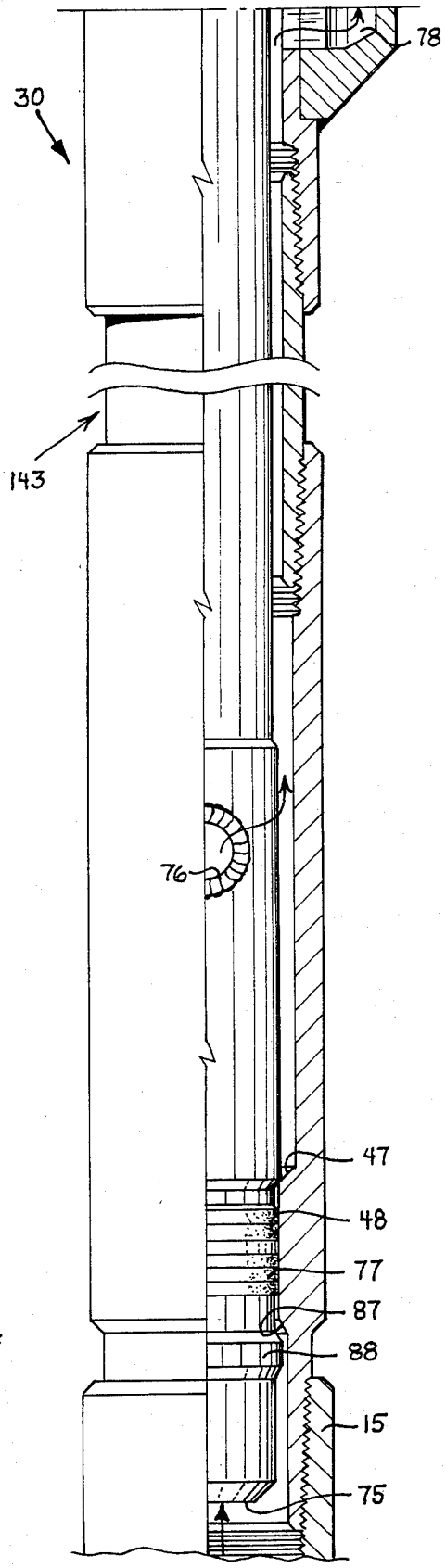

An equalizing prong 235 is slidably disposed in the upper portion of pump 30 and has its lower end in close proximity to, or even in contact with, the upper end of equalizing valve 217 as shown in FIG. 2B. The upper end of the prong is enlarged as at 237 and carries seal means such as seal rings 238 disposed in suitable external annular recesses. These seal rings 238 normally sealingly engage the inner wall of bore 151 of upper housing section 140 to prevent the passage of fluids therebetween.

Prong 235 has an upwardly opening bore 240 which is reduced as at 241 and extends to a level just below spider ports 208. The outside diameter of prong 235 is reduced as at 243 providing a downwardly facing shoulder spaced well above spider 200. This reduced portion 243 of the prong passes through spider 200 as shown and extends therebelow for a purpose to be described.

The prong is formed with a pair of opposed lateral apertures as at 245 which are located on a level with the annular recess 247 formed in the exterior surface of the prong. Suitable seal rings 248 are carried in suitable seal ring recesses above and below the prong's external recess and sealingly engage the inner wall of bore 202 of spider 200 to prevent leakage between the spider and prong.

Thus, power fluids arriving at the pump 30 from the surface through the power fluid conduit 34 will be directed downwardly through the connector 32 and downwardly along the central bore 240 of the equalizing prong 235. Then, this power fluid is directed outwardly through the prong's lateral aperture 245 into its external recess 247. From this recess, the power fluid is directed through lateral ports 208 of the spider and ports 166 of the crossover housing 160, into internal recess 168 of lantern ring 164, and through lateral ports 50 to the exterior of the pump 30, to be directed into the bypass passage 56 of the receptacle 20 which then conducts it to the power fluid intake ports 58 in the valve section 142 of the pump to power the same in the manner described in my co-pending prior application.

The equalizing prong 235 extends downwardly through spider 200 and has an equalizing spider 255 attached thereto by any suitable means such as the threads 256 as shown.

Equalizing spider 255 is formed with a plurality of spaced apart legs 258 providing fluid passages therebetween so that well production fluids pumped by the upper pump section may flow upwardly through the central passage of the pump, through equalizing valve 217, between legs 258 of the equalizing spider 255, upwardly between the equalizing prong 235 and the inner wall of housing 160, through vertical passages 204 of spider 200, and upwardly to discharge ports 84, then outwardly therethrough to continue its movement to the surface through the well tubing 15, as shown by the arrows.

Well production fluids pumped by the lower pumping section exit the pump through discharge port 76, flow upwardly to the lower end of bypass 78, flow therethrough, and empty into the pump receptacle above upper seal ring set 52 as shown by the arrows. Here, this fluid mixes with that from the upper pump section and is forced to the surface therewith.

When it is desired to remove the pump 30 from the well, it may normally be pulled by withdrawing the power fluid conduit 34 after first bleeding the pressure therefrom. Should, however, the pump fail to pull from its receptacle with application of reasonable force, the conduit may be disconnected from the pump by actuating the connector, after which the conduit and the connector may be lifted freely from the well. In such case, a suitable retrieving tool such as the Otis Type "GS" or "GR" Pulling Tool, available from Otis Engineering Corporation, Dallas, Tex., may be used with suitable running means to retrieve the pump.

When the connector 32 is actuated to release the conduit from locking engagement with the pump 30, the equalizing mechanism of the pump is automatically actuated so that the pump will then be easier to pull from the receptacle 20 because the production fluid in the tubing above the pump and supported by the pump's standing valves (not shown) can bypass these standing valves and drain from the tubing into the surrounding annulus until stabilization or equalization of pressures is reached.

To actuate the connector 32, the power fluid conduit is relieved of its pressure and opened at its upper end. A ball such as ball 270, seen in FIG. 6A, or similar suitable closure member, is dropped into the conduit and allowed to gravitate to the connector and become engaged with seat surface 115*a*. Injection of power fluid could be used to hasten the ball's descent. The conduit is then pressurized. This pressure acts downwardly across that area sealed by seal rings 117 since ball 270 now closes bore 115 of connector body 114. When the downward force of this pressure reaches a predetermined value, shear pin 118 will fail, and body 114 together with its extension 121 and seal mandrel 124 attached thereto will move down until downwardly facing shoulder 116*a* near the upper end of the body engages upwardly facing shoulder 107*a* of the connector housing 104 to arrest this movement. Such movement releases the connector and also opens the equalizing passages as clearly shown in FIGS. 6A and 6B.

It will be seen in FIG. 6A that the body extension 121 has moved down relative to the collet fingers 137 to a position wherein it no longer supports these fingers against inward movement, surface 126 of the extension now being below the lower end of these fingers. The connector may now be lifted. It will readily pull free of the pump since the unsupported collet fingers will be cammed inwardly as the cam surface at the upper end of their bosses engage the downwardly facing shoulder 154 at the upper end of recess 153 in the fishing neck of pump 30.

When the connector was actuated and the body 116 and its extension 121 moved downwards, the seal mandrel 124 on the lower end thereof moved downwards also. Thus, its lower end engaged the upper end of the equalizing prong 235 and moved the prong to its lowermost position, shown in FIG. 6B. This downward movement of the prong also caused the equalizing spider 255 on the lower end thereof to move the equalizing valve 217 downward to its lowermost position and uncover equalizing port 218 in the surrounding housing.

With equalizing port 218 open, well fluids in the tubing above the pump may move downward around the upper portion of the pump, enter the pump through discharge ports 84 and flow downward inside the pump and through spider passages 204 to the equalizing ports 218 where they exit the pump (this is below seal ring set 54) and then flow downwardly between the pump and its receptacle to the inlet ports 80 of the receptacle where they flow outwardly into the surrounding annulus. This action will continue until stabilization or equalization occurs. Of course, some fluid may, at the same time, move downwards through the pump's fishing neck and through the upper portion of the equalizing prong to exit through its lateral aperture 245 now situated below the spider 200 and move toward the equalizing port together with the fluids flowing down through the spider.

When the connector 32 is actuated to releasing position, the equalizing port 218 is opened and equalization begins. The connector can be withdrawn from the pump's fishing neck immediately or at a later time and such equalization will continue. Thus, after withdrawal of the power fluid conduit, when a retrieving tool is lowered into the well tubing to retrieve the pump, equalization of pressures will normally be completed, and the pump can be pulled or jarred from the receptacle without undue difficulty.

The retrieving tool may be lowered into the well tubing by any suitable means, such as wireline, jointed pipe, coil tubing, sand line, sucker rods, or the like.

Figure 6A:
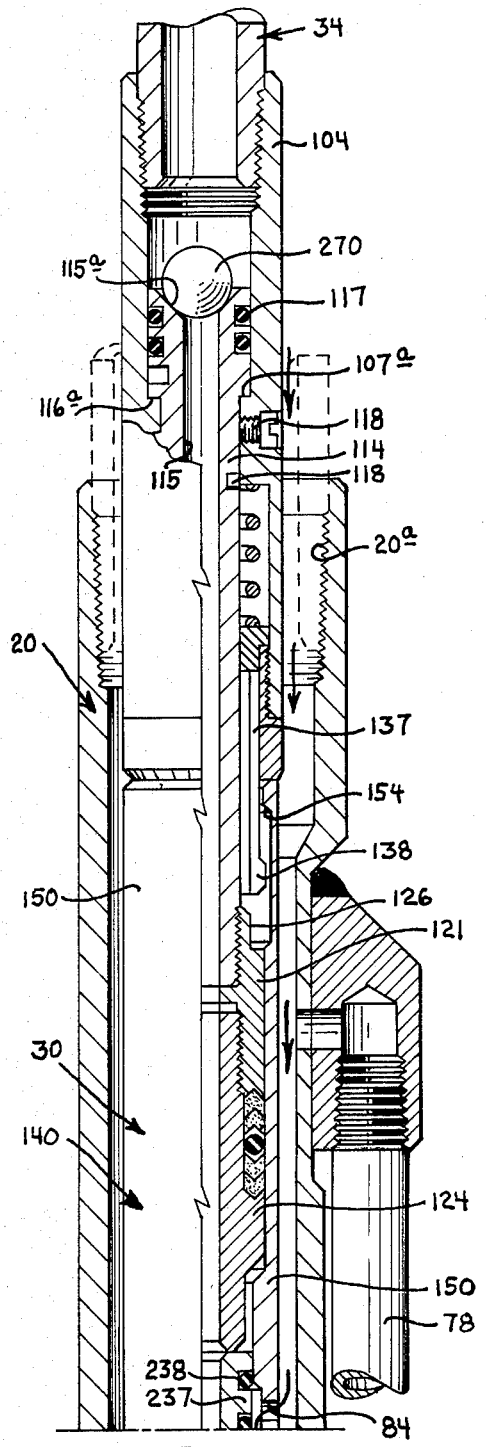
FIGS. 6A and 6B, taken together, constitute a fragmentary longitudinal view, partly in elevation and partly in section, with some parts broken away, showing an upper portion of the well pump of FIGS. 2A–2D with the equalizing passages open and the power fluid conduit ready to be withdrawn from the pump.
Figure 6B:
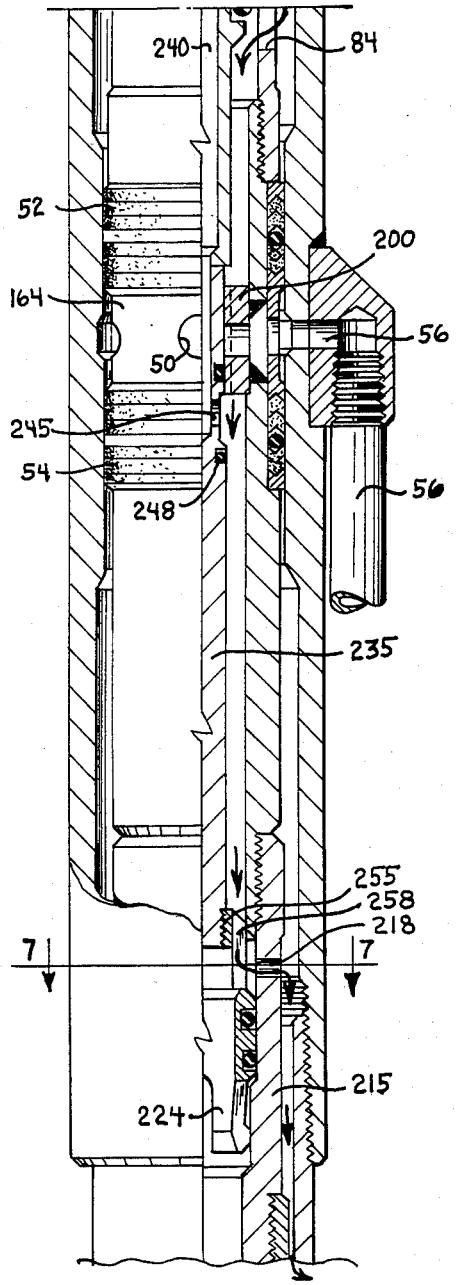
Figure 7:
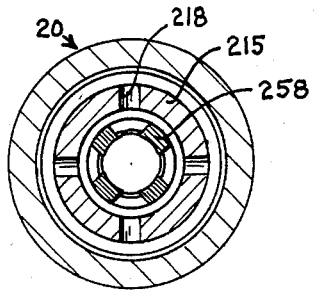
FIG. 7 is a cross-sectional view taken along line 7—7 of FIG. 6B.

It will be noticed in FIGS. 2A and 6A that the thread 20*a* at the upper end of receptacle 20 is not concentric with the polished bore portions 48*a*–48*e*. Such eccentricity has been introduced into the receptacle structure to further adapt this pump to wells having small diameter casings. Thus, the receptacle bore is effectively displaced to one side to gain additional space for the external bypass and exhaust conduits 56, 78, and 74*a* which, in spite of the way they are shown herein, are preferably grouped on one side of the receptacle, conduits 56 and 74*a*, being smaller in section than conduit 78, are spaced about 35 degrees on either side thereof as shown in my aforementioned co-pending application. This structure makes it practical to install a pump in a well having 4 inch inside diameter casing and 2⅜ inch tubing in which the annulus therebetween would be so small that an external power fluid conduit would be quite impractical.

It should be understood that this invention not only provides the downhole well pump 30, the pump receptacle 20, and the connector 32, but also provides installations utilizing them. Such installations may be typified by the installation illustrated in FIG. 1, but installations utilizing the apparatus of this invention need not include well casing, although such is customary in actual practice. It should be further understood that this invention also includes methods of running such well pumps on conduits which are connected to the pumps with connectors which are remotely releasable, enabling the power fluid conduit to be retrieved from the well independently of the pump. Thus, the pump may be retrieved with the conduit or the conduit may be withdrawn without the pump. The conduit may be replaced in the well and relatched to the pump as it was before. In addition, the pump may be run into the well and installed in its receptacle by use of means other than the power fluid conduit, after which the conduit may be run into the well and connected to the pump.

In wells where the receptacle 20 is located at considerable depth or where the well bore above the receptacle is deviated, the pump and the power fluid conduit should be installed and removed separately.

It should be readily seen that the pump 30 and the conduit 34 are ideal for use in deviated wells, since the running of well tubing with an external power fluid conduit attached thereto is especially risky in deviated wells. No such danger is attendant with the apparatus of this invention.

The methods may include installing a pump having a power fluid conduit made up entirely of jointed pipe, or entirely of coil tubing, or coil tubing with at least one joint of pipe next to the pump and/or at least one joint of pipe at its surface end.

The connector, in each case, serves to releasably connect the lower end of the power fluid conduit to the pump. This connector, as disclosed hereinabove, is remotely releasable, being responsive to dropping a ball, or the like, into the conduit, allowing the ball to settle to the connector where it engages on a seat surface, and pressuring the conduit thereabove to apply a downward differential pressure across the ball and seat to actuate the connector to released position, and lifting the connector and conduit free of the well. Actuation of the connector to releasing position automatically actuates the equalizing mechanism in the pump to equalizing or drain position to permit equalization of pressures across the pump to render it easier to withdraw from its receptacle in due course.

The foregoing description and drawings of this invention are explanatory and illustrative only, and various changes in sizes, shapes, material, and arrangements of parts, as well as certain details of construction, may be made within the scope of the appended claims without departing from the true spirit of the invention.

I claim:

1. A downhole well pump, comprising:

a. downhole pump means installable in a well flow conductor for pumping production fluids to the surface, said pump means being operable by pressurized power fluid conducted thereto from the surface through a power fluid conduit connectable to said pump means, said pump means having a fishing neck at its upper end providing a downwardly facing shoulder; and b. connecting means connectable between said power fluid conduit and said pump means, said connecting means including:

i. a latch housing having a bore therethrough, said latch housing being connectable to a power fluid conduit and having a lateral breather port through its wall;

ii. a latch mandrel having a bore therethrough, said latch mandrel having its upper portion slidably mounted in said bore of said latch housing and having expander means thereon;

iii. frangible means releasably holding said latch mandrel in position in said latch housing;

iv. collect means slidably mounted about said latch mandrel and having collet fingers thereon each having an upwardly facing shoulder engageable with said downwardly facing shoulder of said pump means, said collet means being slidable longitudinally on said latch mandrel between engaged and disengaged positions;

v. means biasing said collet means longitudinally of said latch mandrel toward engaged position; and vi. means sealing between said latch mandrel and said latch housing above said lateral breather port and between said latch mandrel and said housing of said well pump, said connecting means being releasable from said pump means remotely by causing said latch mandrel to shear said frangible means and move longitudinally of said latch housing and said collet means to move said holding means of said latch mandrel to a position to release said collet fingers from engagement with said downwardly facing shoulder of said pump means, whereby said power fluid conduit is removable from said well flow conductor independent of said downhole pump means.

2. The downhole well pump of claim 1, wherein said connecting means is latchable to said pump automatically when said connecting means engages said pump and a predetermined axial force is applied thereto.

3. The apparatus of claim 2, wherein said latch mandrel is formed with a seat surface surrounding its bore, said seat surface being engageable by a ball dropped into the power fluid conduit at the surface and allowed to engage said seat, and said latch mandrel is moveable longitudinally to its latch releasing position responsive to fluid pressure applied across said ball and seat to shear said shear pin means and move said latch holding means to latch releasing position.

4. The apparatus of claim 3, wherein said housing means is provided with equalizing port means, and relatively movable equalizing valve member means is provided for initially sealing said equalizing port means, said equalizing valve member means being displaceable to open said equalizing port means in response to said connecting means being actuated to latch releasing position to equalize fluid pressures in said well tubing above and below said well pump.

5. The downhole well pump of claim 1, 2, 3, or 4, wherein said pump means includes receptacle means having a tubular body connectable to said well flow conductor and having means in its bore for supporting said pump means therein in sealing relation therewith, and wherein said receptacle means is provided with port means and bypass passage means for conducting power fluid and production fluid to and away from said pump separately.

6. A well installation, comprising:

a. a well bore penetrating an oil producing formation;

b. a well tubing in said well bore;

c. a downhole well pump supported in sealing relation in said well tubing;

d. a power fluid conduit connected to said well pump for supplying pressurized fluid for powering said pump; and e. releasable connecting means connecting said power fluid conduit to said well pump, said well pump being provided with latch recess means and said connecting means including latch members and means for holding said latch members in latching engagement with said latch recess, and spring means is provided for biasing said latch member longitudinally to a position of engagement with said holding means, said connecting means automatically connecting said power fluid conduit to said well pump upon said connecting means engaging said well pump, said connecting means being releasable remotely to permit withdrawl of said power fluid conduit from said well independent of said well pump.

7. The installation of claim 6, wherein said holding means is longitudinally movable between latch holding and latch releasing positions and wherein said holding means is formed with a longitudinal bore therethrough and with a seat surface surrounding the upper end of said bore, and said holding means is movable to releasing position in response to application of fluid pressure across a ball dropped into the power fluid conduit and allowed to engage said seat surface of said holding means.

8. The installation of claim 7 wherein said holding means of said connecting means is held in latch engaging position by shear pins means, said shear pin means being shearable when the differential pressure acting across said ball and seat reaches a predetermined value.

9. The installation of claim 8, wherein said pump includes a tubular body having equalizing port means in the wall thereof and relatively movable equalizing port closure means closing said equalizing port means, said equalizing port closure means being displaceable to uncover said equalizing port means in response to said connecting means being actuated to latch releasing position to equalize fluid pressures in said well tubing above and below said well pump.

10. The installation of claim 9, wherein spent power fluid from said well pump is exhausted into the annulus surrounding said well tubing at a location a spaced distance above said well pump and production fluids are moved to the surface through said well tubing and exterior of said power fluid conduit.

11. The installation of claim 7, 9, or 10, wherein at least a portion of said power fluid conduit is coil tubing.

12. The installation of claim 7, 9, or 10, wherein at least a portion of said power fluid conduit is jointed pipe.

13. The installation of claim 7, 9, or 10, wherein said well tubing includes receptacle means having a tubular body connectable to said well flow conductor and having means in its bore for supporting said pump means therein in sealing relation therewith, and wherein said receptacle includes port means and bypass passage means for conducting power fluid and production fluid to and away from said pump separately.

14. The installation of claim 6, 7, 9, or 10, wherein said power fluid conduit includes at least one gas lift valve.

* * * * *